US007325260B1

(12) United States Patent
Hoyt

(10) Patent No.: US 7,325,260 B1
(45) Date of Patent: Feb. 5, 2008

(54) BAG AND APPARATUS FOR RETROFITTING AN EXTENDABLE AND RETRACTABLE SHOWERHEAD TO EXISTING FIXED SHOWERHEAD LOCATIONS

(76) Inventor: Bruce E. Hoyt, 121 Balmoral Dr., Bolingbrook, IL (US) 60440

( * ) Notice: Subject to any disclaimer, the term of this patent is extended or adjusted under 35 U.S.C. 154(b) by 0 days.

(21) Appl. No.: 11/656,169

(22) Filed: Jan. 22, 2007

(51) Int. Cl.
*A47K 3/22* (2006.01)
*A47K 3/34* (2006.01)
*A47K 3/36* (2006.01)

(52) U.S. Cl. ..... 4/615; 4/567; 4/570

(58) Field of Classification Search ..... 4/567, 4/568, 570, 601, 615, 678; 239/195; 137/801
See application file for complete search history.

(56) References Cited

U.S. PATENT DOCUMENTS 6,381,770 B1 * 5/2002 Raisch ..... 4/570
7,065,807 B1 * 6/2006 Stout, Jr. ..... 4/615

* cited by examiner

*Primary Examiner*—Tuan Nguyen
(74) *Attorney, Agent, or Firm*—Allan J. Franowsky

(57) ABSTRACT

This invention describes an extendable and retractable showerhead connected to a flexible hose that inserts behind a shower wall when stored. The showerhead can remain in its stored position for use, or pulled out and extended to reach all areas of the body when showering. A double bag is described that resides behind the shower wall to act as a receptacle within which the flexible hose is inserted into when stored.

5 Claims, 2 Drawing Sheets

BAG AND APPARATUS FOR RETROFITTING AN EXTENDABLE AND RETRACTABLE SHOWERHEAD TO EXISTING FIXED SHOWERHEAD LOCATIONS

BACKGROUND OF THE INVENTION

1. Field of the Invention

This invention generally pertains to showerheads that are installed in a fixed location over bathtubs and in shower stalls. Specifically, this invention provides a protective bag and apparatus for retrofitting or installing an extendable and retractable showerhead at a location where a fixed showerhead currently exists.

2. Description of the Prior Art

Showerheads mounted in a fixed location on a wall above bathtubs and in shower stalls generally provide a limited shower experience because not all areas of the body are able to receive a direct stream of water from the showerhead for complete washing and rinsing. This problem is normally solved by purchasing an extendable showerhead with a hose that can be mounted on the current water supply pipe and used either in a position close to that of the previously fixed showerhead or removed from that position and held in the hand. This provides a direct stream of water easily directed to any part of the body for complete rinsing. A drawback of this arrangement is that when the showerhead is replaced to its storage position on the wall, the full length of the hose hangs down above the tub or along the shower stall wall. The hose is unsightly in this position and could be a obstacle or a safety hazard when entering or exiting the shower area.

U.S. Pat. No. 5,675,847 to Pierre discloses a "U" shaped hose retainer having a cavity for storing a sink sprayer hose. The retainer allows the sprayer hose to retract down into the cavity when the sprayer is placed in its stored position. The retainer prevents the hose from being exposed to under sink plumbing or items that may be stored under the sink. This hose retainer is not flexible and can be made from high impact plastic or light weight metals. The non-flexible nature of the hose retainer eliminates the possibility of retrofitting an extendable showerhead.

U.S. Pat. No. 6,349,428 to Nasr et al. discloses a hand-held shower attached to a hose which is concealed behind a shower wall during storage, but extends out of the wall when used as a hand-held shower head. Behind the shower wall is a solid housing securely mounted to that shower wall. The housing accommodates the hose when the hose is retracted into the wall when storing the shower head. The housing provides a drain at the bottom to direct any water leaks out to the outside of the shower wall to prevent water damage to the wall. The housing was securely mounted behind the shower wall when the wall was originally built.

U.S. Pat. No. 6,381,770 to Raisch discloses an extendable bathtub spout. This spout has an extendable hose attached to a water supply. The spout normally rests in a stationary base and can be pulled out from the stationary base when the user desires to use it in the extended position. The hose is stored in a cavity behind the stationary base. That cavity may contain an optional protective bag.

U.S. Pat. No. 6,470,510 to Nasr et al. discloses a pullout hand-held shower that retracts into a housing concealed behind a shower wall. This housing is solid with one or more external recesses to assist in mounting the housing to the wall. A drain is provided at the bottom of the housing to redirect any leaks to the outside of the wall to prevent water damage to the wall. This housing was securely mounted to the shower wall when the wall was originally built.

In all of the above patents referenced, none of them could be used to retrofit their disclosed devices to replace existing fixed shower heads with extendable shower heads. The devices disclosed in the above patents were built in and mounted when the sinks or bathtubs and walls were originally built.

In conventional shower head installations, the shower head is either fixed on a wall above a bathtub or on the wall of a shower stall. The need exists for a easy method to retrofit an extendable shower head located at essentially the same location as the fixed shower head without having an external hose hanging above the tub or adjacent to the wall of the shower stall when not in use. Further, this apparatus must include a means to prevent the hose from engaging obstacles such as wood supports or studs, wood splinters, nails, plumbing, electrical conduits and any other structural components that may exist behind the wall.

SUMMARY OF THE INVENTION

An object of the present invention is to make it convenient to replace the current fixed showerhead mounted on a wall above the tub or in a shower stall with an extendable showerhead that can be hand held to deliver water to any part of the body for washing and rinsing.

Another object of the invention is to provide an innovative way to store the extendable hose without leaving an unsightly hose hanging over the tub or in the shower stall. Storing the hose in that manner prevents the hose from being a possible obstacle or safety hazard.

A further object of the invention is to provide a flexible double bag, comprised of an outer durable woven bag within which is a heavy plastic bag, both bags attached to each other at the opening of each bag, to be fastened behind the wall to allow the extendable hose to insert into as the shower head is retracted to its storage position. The double bag provides protection to minimize the hose from being snagged by plumbing, wall studs, splinters and nails that may be exposed. Without the double bag installed, the hose would be subject to snagging and damage to the hose.

A further object of the invention is that the extendable hose will accommodate commercially available shower heads.

A further object of the invention is that a provision should be provided to mount the shower head on the wall in the approximate location of the original fixed shower head.

The preferred embodiment of the present invention consists of four "U" shaped channels that slide over four straight cuts in drywall that define a square shaped hole. These channels have two or more hooks to receive corresponding eyelets that are mounted on the double bag. The double bag has a weighted bottom to keep the double bag fully deployed when extending the hose out of it and retracting the hose into it. This double bag hangs behind the wall and the channels have provisions to mount a faceplate to cover the square hole. The double bag prevents interference from structures behind the wall including plumbing, splinters, nails or whatever else that could snag the hose. The faceplate has an aperture to house a spout within which the hose can mount and provide a standard fixed shower experience. That mount is also a storage position when the shower is not extended.

DETAILED DESCRIPTION OF THE INVENTION

Figure 1:
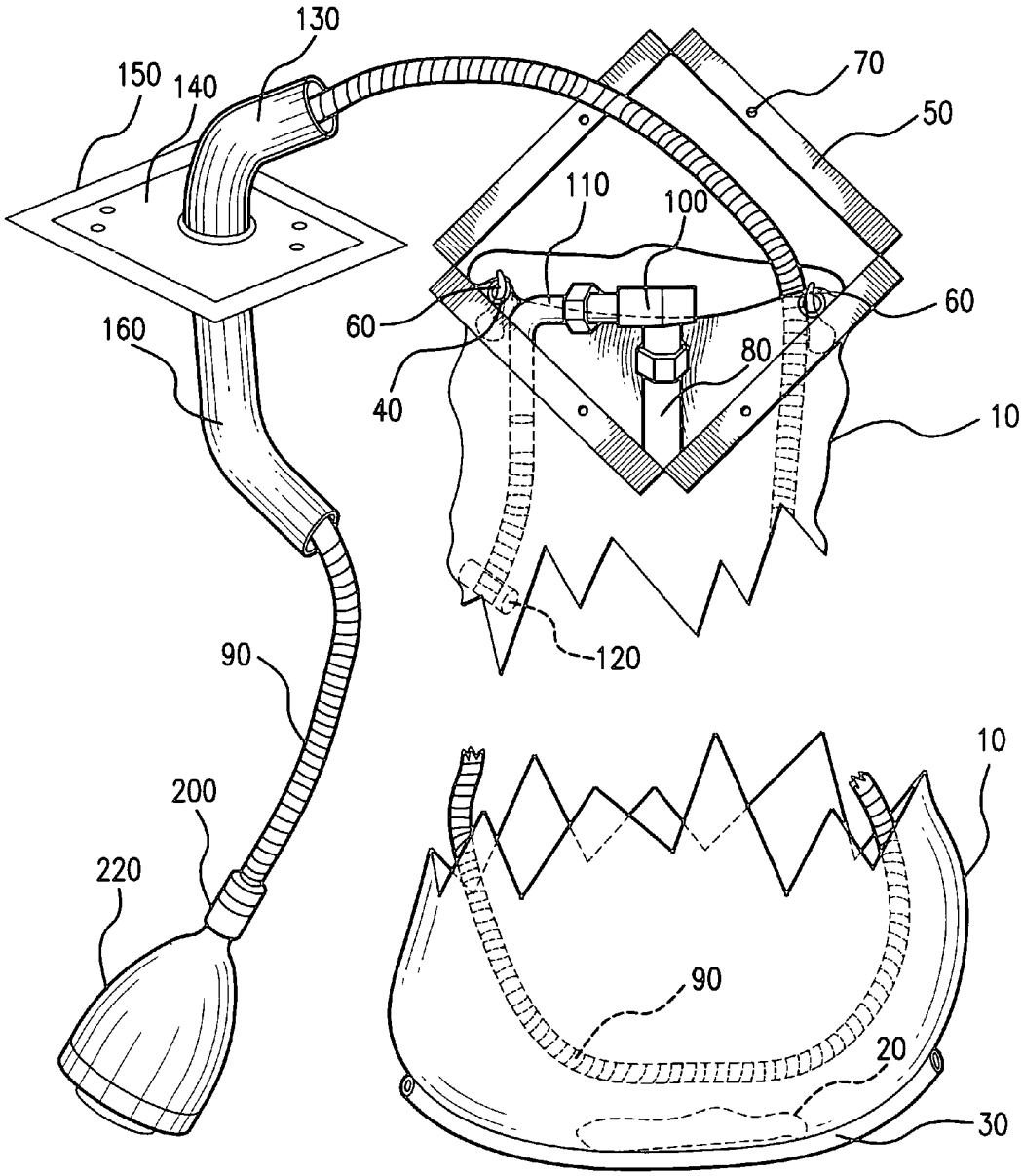
FIG. 1 is a view of the components of the invention in a partially exploded view.
Figure 2:
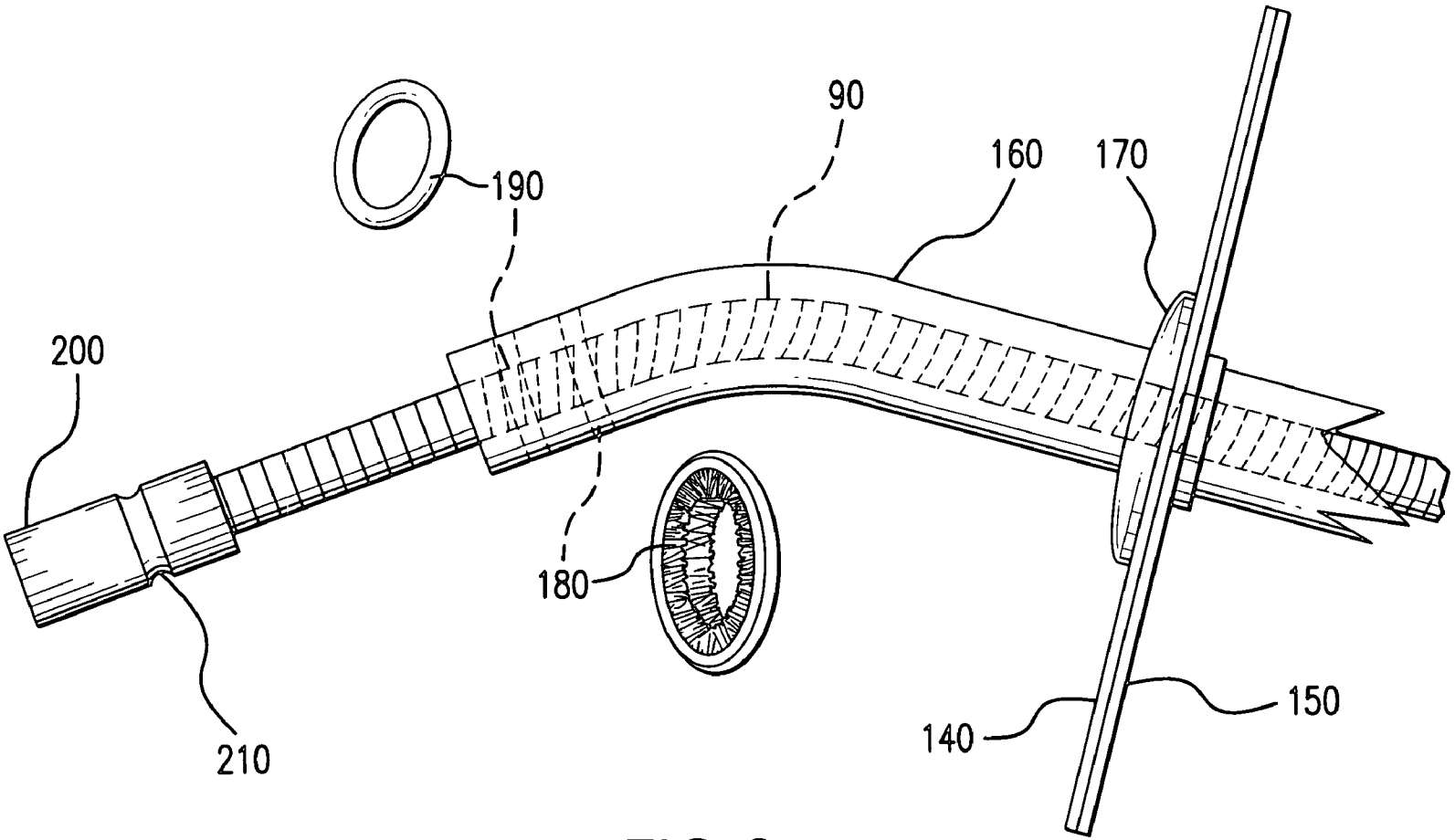
FIG. 2 is a detailed view of the water spout where the hose is supported when stored or used as a fixed shower head.

This invention discloses a novel containment bag 10 and apparatus that facilitates retrofitting, at the location of a fixed shower head, an extendable hose and shower head. The unique feature of the invention is that the retrofit procedure provides for the storage of a stainless steel corrugated flex hose 90 behind the wall instead of remaining hanging out over the tub or in the shower stall. This keeps an unsightly hose out of sight and removes a possible obstacle and safety hazard that an external hose would pose. The key to this invention is the containment bag 10. Containment bag 10 is composed of two bags, one inside the other, while both are connected together at the opening of each one. At the connection, at least two eyelets 40 are installed in the containment bag 10 to attach containment bag 10 to at least two hooks 60 to mount the containment bag 10 in the desired position. The outer bag is a tightly woven material of a slippery synthetic substance, such as nylon thread, to allow the bag to slip easily behind the wall during installation, sliding past any obstructions or structures. The inner bag is made of a water proof heavy plastic material with a silica crystal pouch 20 in the bottom of the inner bag to protect from moisture. The general shape of the containment bag 10 is that it is about three inches deep, and about eight inches wide at the top where both bags are attached. The width at about 75% down toward the bottom is roughly sixteen inches. The remainder of the bag rounds out to the center at the bottom. The total length of the containment bag 10 is about four feet long. Attached to the very bottom of the containment bag 10 is flexible tube weight 30. Flexible tube weight 30 aids to pull the containment bag 10 down the cavity behind the wall during installation and serves to keep the containment bag 10 taut along the width after the containment bag 10 is in place.

The current water supply pipe 80 is used with a compression elbow 100 affixed to a ninety degree elbow 110 to which one end of the stainless steel corrugated flex hose 90 is attached. In this embodiment, a square hole is cut through the drywall, with each edge of the square dressed with a "U" shaped channel 50. The two or more hooks 60 are attached to the "U" shaped channel 50. Pre-drilled holes 70 are drilled in "U" shaped channel 50 to accept faceplate 140 to which a gasket 150 and leader pipe 130 are mounted. Stopper 120 is attached to stainless steel corrugated flex hose 90 to prevent the stainless steel corrugated flex hose 90 from overextending.

Spout 160 attaches opposite leader pipe 130 on face plate 140. An escutcheon 170 provides a finished look where spout 160 attaches to face plate 140. The second end of the stainless steel corrugated flex hose 90 is attached to coupling 200. Spout 160 houses resilient "O" ring 190 and pile ring 180. Coupling 200 is shaped with a groove 210 formed to engage resilient "O" ring 190 when the shower head 220 is in the stored position or in a position to be used as a fixed shower head.

The foregoing description of a preferred embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

I claim:

1. An extendable and retractable showerhead, comprising:

a. two bags of the same size, one bag inside the other defining an inner and outer bag, each joined to the other at the opening of each bag;

b. at least two eyelets mounted at the opening the bags;

c. a plurality of U-shaped channels that fit and dress the straight edges of drywall, or other material that composes the wall, that define the square aperture through which the bags are inserted;

d. at least two hooks mounted on some of the U-shaped channels to engage the eyelets of the bags as the bags hang behind the wall;

e. an extendable hose having one end attached to a water supply pipe, and the other end attached to a showerhead; and f. a faceplate attached to the U-shaped channels.

2. The outer bag of claim 1 wherein the structure of the outer bag is a tightly woven material of a synthetic thread.

3. The inner bag of claim 1 wherein the structure of the bag is a waterproof plastic material.

4. The bags of claim 1 wherein the length of the inner and outer bags is sufficient to store the extendable hose when fully retracted into its stored position.

5. The faceplate of claim 1 wherein a spout is attached to the faceplate to guide the flexible hose for extension and retraction of the extendable showerhead.

* * * * *